US009590303B2

(12) United States Patent
Kao et al.

(10) Patent No.: US 9,590,303 B2
(45) Date of Patent: Mar. 7, 2017

(54) ANTENNA

(71) Applicant: ASUSTeK COMPUTER INC., Taipei (TW)

(72) Inventors: Yeh-Chun Kao, Taipei (TW); You-Fu Cheng, Taipei (TW); Yu-Chia Chang, Taipei (TW)

(73) Assignee: ASUSTeK COMPUTER INC., Taipei (TW)

( * ) Notice: Subject to any disclaimer, the term of this patent is extended or adjusted under 35 U.S.C. 154(b) by 365 days.

(21) Appl. No.: 14/138,119

(22) Filed: Dec. 22, 2013

(65) Prior Publication Data

US 2014/0210682 A1 Jul. 31, 2014

Related U.S. Application Data

(60) Provisional application No. 61/757,718, filed on Jan. 29, 2013.

(30) Foreign Application Priority Data

Sep. 3, 2013 (TW) ..... 102131729 A

(51) Int. Cl.
*H01Q 7/00* (2006.01)
*H01Q 5/371* (2015.01)

(52) U.S. Cl.
CPC ..... *H01Q 7/00* (2013.01); *H01Q 5/371* (2015.01)

(58) Field of Classification Search
CPC ..... H01Q 7/00; H01Q 5/371
See application file for complete search history.

(56) References Cited

U.S. PATENT DOCUMENTS

| | | | | |
|---|---|---|---|---|
| 6,853,341 | B1 * | 2/2005 | Hellgren | H01Q 1/3275 343/742 |
| 8,207,895 | B2 | 6/2012 | Wong et al. | |
| 9,077,077 | B2 | 7/2015 | Wong et al. | |
| 2006/0158379 | A1 * | 7/2006 | Ishimiya | H01Q 7/00 343/741 |
| 2007/0132641 | A1 * | 6/2007 | Korva | H01Q 5/371 343/700 MS |
| 2008/0180333 | A1 * | 7/2008 | Martiskainen | H01Q 5/371 343/722 |

FOREIGN PATENT DOCUMENTS

| | | | |
|---|---|---|---|
| TW | I336541 | B | 1/2011 |
| TW | 201104960 | A1 | 2/2011 |
| TW | M426892 | U1 | 4/2012 |
| TW | 201304273 | A1 | 1/2013 |
| WO | 2005043674 | A1 | 5/2005 |
| WO | 2011022698 | A1 | 2/2011 |

* cited by examiner

*Primary Examiner* — Hoang V Nguyen
*Assistant Examiner* — Michael Bouizza
(74) *Attorney, Agent, or Firm* — CKC & Partners Co., Ltd.

(57) ABSTRACT

An antenna device is provided. The antenna includes a feeding end, a grounding end, a loop metal portion and a protruded metal portion. The grounding end is electrically connected to a ground plane. The loop metal portion extends from the feeding end to the grounding end to form a loop antenna structure. The protruded metal portion is electrically connected to the loop metal portion, wherein the distance between the protruded metal portion and the grounding end is shorter than the distance between the protruded metal portion and the feeding end.

13 Claims, 4 Drawing Sheets

ANTENNA

CROSS-REFERENCE TO RELATED APPLICATION

This application claims the priority benefit of U.S. provisional application Ser. No. 61/757,718, filed on Jan. 29, 2013, and TW application serial No. 102131729, filed on Sep. 3, 2013. The entirety of the above-mentioned patent applications are hereby incorporated by reference herein and made a part of specification.

BACKGROUND OF THE INVENTION

Field of the Invention

The invention relates to an antenna and, more particularly to a multiband antenna.

Description of the Related Art

As communication technology develops, electronic devices and wireless applications of the electronic devices are widely used. For example, a 3G smartphone and a personal digital assistant (PAD) are frequently used in daily life. Moreover, wireless communication of the electronic devices is powerful by cooperating with various kinds of antennas, which makes user feel more convenient.

Since mobile communication devices become smaller and thinner gradually, the volume of the antenna becomes smaller. However, in order to maintain a good quality of communication, the bandwidth requirement of the antenna become wider, and the radiation pattern and the radiation efficiency of the antenna should also be taken in consideration. Thus, designing an antenna to meet all the requirements becomes more challenging.

BRIEF SUMMARY OF THE INVENTION

An antenna provided, and it includes a feeding end, a grounding end, a loop metal portion and a protruded metal portion. The grounding end is electrically connected to a ground plane. The loop metal portion extends from the feeding end to the grounding end to form a loop antenna structure. The protruded metal portion is electrically connected to the loop metal portion, and the distance between the protruded metal portion and the grounding end is shorter than the distance between the protruded metal portion and the feeding end, and the protruded metal portion and the loop metal portion form a planar inverted F antenna (PIFA) relative to the feeding end and the grounding end.

DETAILED DESCRIPTION OF TIM EMBODIMENTS

Figure 1:
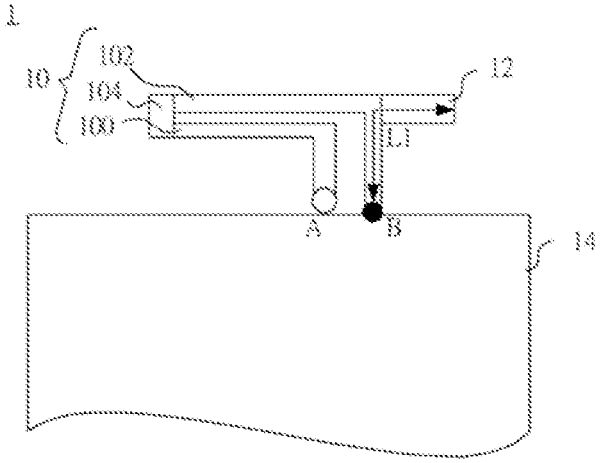
FIG. 1 is a top view showing an antenna in the first embodiment.

Please refer to FIG. 1. FIG. 1 is a top view showing an antenna 1 in the first embodiment. The antenna 1 includes a feeding end A, a grounding end B, a loop metal portion 10 and a protruded metal portion 12.

The feeding end A is used for feeding a signal, and the grounding end B is electrically connected to a ground plane 14. The loop metal portion 10 is extended from the feeding end A to the grounding end B to form a loop antenna structure. In other words, two ends of the loop metal portion 10 are the feeding end A and the grounding end B. In the first embodiment shown in FIG. 1, the loop metal portion 10 is an L-shape loop structure, and it includes a first radiating arm 100, a second radiating arm 102 and a connection arm 104. The first radiating arm 100 is electrically connected to the feeding end A, the second radiating arm 102 is electrically connected to the grounding end B, the connection arm 104 is electrically connected to the first radiating arm 100 and the second radiating arm 102. The first radiating arm 100, the second radiating arm 102 and the connection arm 104 of the loop metal portion 10 can be formed, respectively, and then be electrically connected, or they can be integrally formed, which is not limited herein.

The protruded metal portion 12 is electrically connected to the loop metal portion 10. In the different embodiments, the protruded metal portion 12 and the loop metal portion 10 can be integrally formed, or they can be formed respectively and then electrically connected to each other. The distance between the protruded metal portion 12 and the grounding end B is shorter than the distance between the protruded metal portion 12 and the feeding end A. In the embodiment, the protruded metal portion 12 is rectangle-shaped, and it is formed at the second radiating arm 102 of the loop metal portion 10. Therefore, the protruded metal portion 12 and the loop metal portion 10 form a planar inverted F antenna (PIFA) structure relative to the feeding end A and the grounding end B.

Consequently, the antenna 1 includes two antenna structures. One is the loop antenna structure formed by the loop metal portion 10, and the other one is the PIFA structure formed by the loop metal portion 10 and the protruded metal portion 12.

Figure 2:
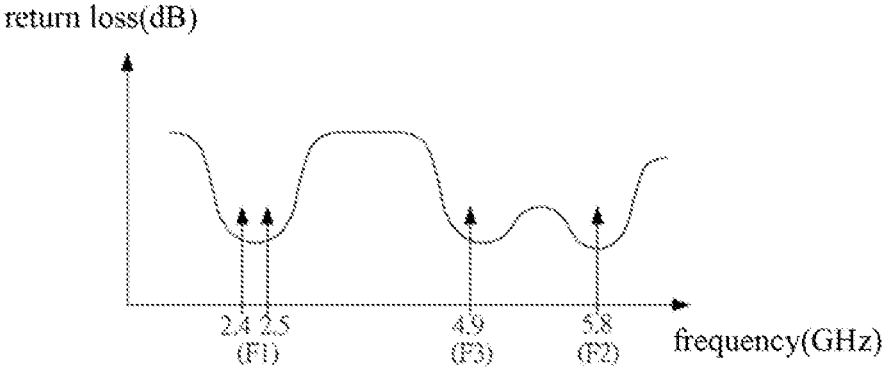
FIG. 2 is a diagram showing a relationship between a return loss of the antenna in FIG. 1 and the frequency in an embodiment.

Please refer to FIG. 2. FIG. 2 is a diagram showing a relationship between a return loss of the antenna in FIG. 1 and the frequency in an embodiment. The horizontal axis represents frequency, the unit is GHz, and the vertical axis represents return loss, and the unit is decibel (dB).

As shown in FIG. 1 and FIG. 2, the loop antenna structure mainly formed by the loop metal portion 10 can generate a low frequency resonance mode and at least one harmonic resonant mode to form a first resonant frequency F1 and a second resonant frequency F2 as shown in FIG. 2. In the embodiment, the second resonant frequency F2 is the second harmonic of the first resonant frequency F1. The PIFA structure formed by the loop metal portion 10 and the protruded metal portion 12 can generate a high frequency resonant mode to form a third resonant frequency F3.

The first resonant frequency F1 and the nearby frequencies provide a first operating band of low frequency, the second resonant frequency F2, the third resonant frequency F3 and the nearby frequencies provide a second operating band of high frequency. The second resonant frequency F2 and the third resonant frequency F3 can determine the bandwidth of the second operating band. In the embodiment, the antenna 1 applied at wireless local area network (WLAN) is taken as an example, the first operating band is between 2400 to 2480 MHz, and the second operating band is between 4800 to 5800 MHz, which is not limited herein. Consequently, an operating band with a bandwidth of 1 GHz is formed at high frequency through the design of the antenna 1. The resonant frequency and the bandwidth of the antenna 1 can be adjusted according to the size or practical applications, which is not limited herein.

In an embodiment, the length of the loop metal portion 10 is from the feeding end A to the grounding end B, and the length is related to the first resonant frequency F1 and the second resonant frequency F2. In another embodiment, as shown in FIG. 1, the length from the protruded metal portion 12 to the grounding end B is the length L1 from a terminal end of the protruded metal portion 12 to the grounding end B, and the length is related to the third resonant frequency F3.

In an embodiment, the length of the loop metal portion 10 is half of wavelength ($\lambda/2$) of the first operating band, the length from the protruded metal portion 12 to the grounding end B is between $\alpha$ quarter to half of wavelength ($\lambda/4$~$\lambda/2$) of the second operating band. Therefore, the low frequency resonance mode of the antenna 1 is generated by the loop metal portion 10, and the high frequency resonant mode is generated by harmonic resonant mode (such as $\lambda$ and $3\lambda/2$ of the first operating band) of the loop metal portion 10 and the protruded metal portion 12.

As stated above, the resonant frequency of the loop metal portion 10 or the protruded metal portion 12 is related to the length of the loop metal portion 10. For example, if the length is longer, the resonant frequency is lower. Furthermore, the impedance matching of the antenna 1 can be adjusted by changing the size of the to metal portion 10 or the protruded metal portion 12.

Consequently, in different embodiments, the resonant frequency, the bandwidth of the operating band, the overall impedance matching and the size of the antenna 1 can be designed more flexibly by adjusting, the shape, the length, the size of the loop metal portion 10 and those of the protruded metal portion 12, or disposing other auxiliary elements.

Figure 3:
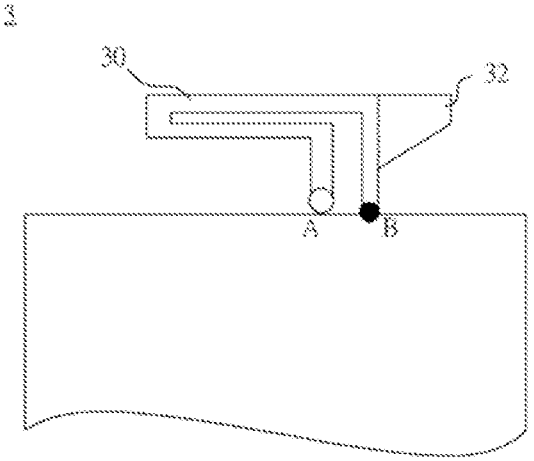
FIG. 3 is a top view showing an antenna in the second embodiment.

Please refer to FIG. 3. FIG. 3 is a top view showing an antenna in the second embodiment. Similar to the embodiment in FIG. 1, the antenna in FIG. 3 includes a feeding end A, a grounding end B, a loop metal portion 30 and a protruded metal portion 32. The differences between the embodiment of FIG. 3 and FIG. 1 are described hereinafter, and the same elements are omitted.

In the embodiment, the protruded metal portion 32 is trapezoid-shaped, and the bottom of the trapezoid is electrically connected to the loop metal portion 30. The length from the protruded metal portion 32 to the grounding end B is the length from the topline of the trapezoid to the grounding end B, which can affect the resonant frequency. In addition, compared to FIG. 1, the impedance matching of the antenna 3 can be adjusted more flexibly by changing the size of the trapezoid.

Figure 4:
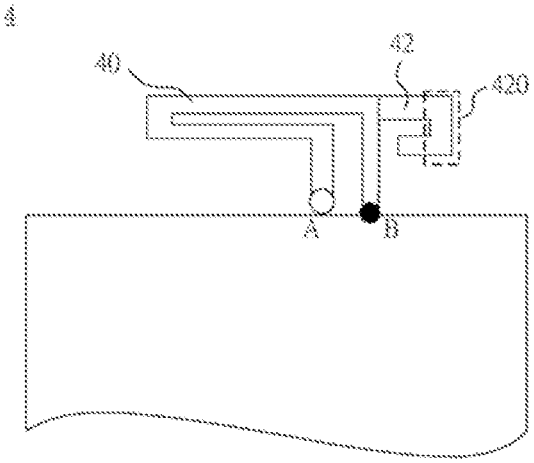
FIG. 4 is a top view showing an antenna in the third embodiment.

Please refer to FIG. 4. FIG. 4 is a top view showing an antenna in the third embodiment. Similar to the embodiment in FIG. 1, the antenna in FIG. 4 includes a feeding end A, a grounding end B, a loop metal portion 40 and a protruded metal portion 42. The differences between the embodiment of FIG. 4 and FIG. 1 are described hereinafter, and the same elements are omitted.

In the embodiment, the protruded metal portion 42 includes a bending portion 420. The length from the protruded metal portion 42 to the grounding end B is extended via the bending portion 420, and the size is increased accordingly, so as to adjust the resonant frequency and the impedance matching. For example, the protruded metal portion 42 in a rectangle-shape usually has a large area. However, since the bending portion 420 can be bonded and extended reversely, the area can be reduced, and the length from the protruded metal portion 42 to the grounding end B is longer. The number of bending portions of the protruded metal portion 42 can be increased to further reduce the occupied space, and the requirements on the resonant frequency and the bandwidth still can be met.

Figure 5:
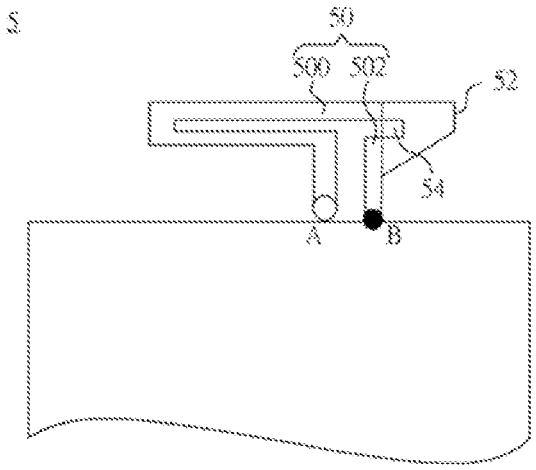
FIG. 5 is a top view showing an antenna in the fourth embodiment.

Please refer to FIG. 5. FIG. 5 is a top view showing an antenna in the fourth embodiment. Similar to the embodiment in FIG. 1, the antenna in FIG. 5 includes a feeding end A, a grounding end B, a loop metal portion 50 and a protruded metal portion 52. The differences between the embodiment of FIG. 5 and FIG. 1 are described hereinafter, and the same elements are omitted.

In the embodiment, a slot 54 is formed between the protruded metal portion 52 and the loop metal portion 50. A first portion 500 and a second portion 502 are separated by the slot 54, and the first portion 500 and the second portion 502 are electrically connected via the protruded metal portion 52. Thus, the length of the loop metal portion 50 is equal to the total length of the first portion 500, the second portion 502 and the protruded metal portion 52. Consequently, an additional length is got by the protruded metal portion 52, and the first portion 500 and the second portion 502 of the loop metal portion 50 can be selected more flexibly in designing to meet the requirements of the resonant frequency and the bandwidth.

Figure 6:
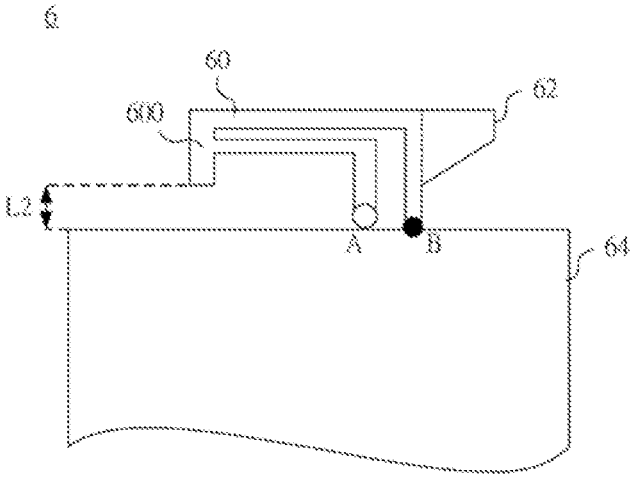
FIG. 6 is a top view showing an antenna in the fifth embodiment.

Please refer to FIG. 6. FIG. 6 is a top view showing, an antenna in the fifth embodiment. Similar to the embodiment in FIG. 1, the antenna in FIG. 6 includes a feeding end A, a grounding end B, a loop metal portion 60 and a protruded metal portion 62. The differences between the embodiment of FIG. 6 and FIG. 1 are described hereinafter, and the same elements are omitted.

In the embodiment, the loop metal portion 60 further includes a current null region 600. The current null region 600 is the region with the minimal current. In an embodiment, the current null region 600 is at the position which is approximately half of the loop metal portion 60. The size of the current null region 600 can be used for determining the resonant frequency of the loop antenna structure formed by the loop metal portion 60. For example, if the size of current null region 600 is larger, the resonant frequency shifts towards a lower frequency, and the size also helps to adjust the impedance matching of the antenna 1.

In an embodiment, the length L2 from the current null region 600 to a ground plane 64 can determine a coupling capacitance formed by the current null region 600 and the ground plane 64, so as to adjust the resonant frequency of the loop metal portion 60. For example, if the length L2 from the current null region 600 to the ground plane 64 is shorter, the coupling capacitance formed by the current null region 600 and the ground plane 64 is larger, and thus the resonant frequency is lower. Moreover, the length L2 also helps to adjust the impedance matching.

Figure 7:
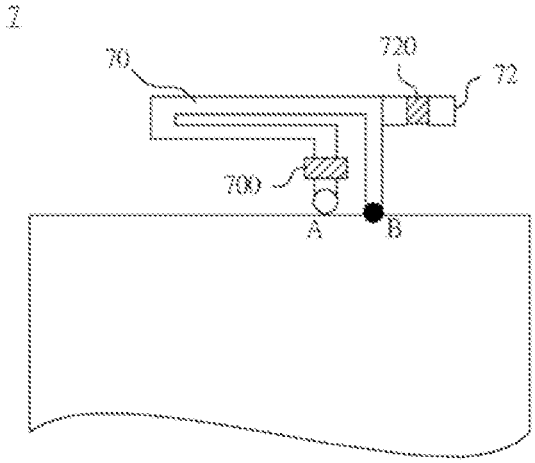
FIG. 7 is a top view showing an antenna in the sixth embodiment.

Please refer to FIG. 7. FIG. 7 is a top view showing an antenna in the sixth embodiment. Similar to the embodiment in FIG. 1, the antenna in FIG. 7 includes a feeding end A, a grounding end B a loop metal portion 70 and a protruded metal portion 72. The differences between the embodiment of FIG. 7 and FIG. 1 are described, hereinafter, and the same elements are omitted.

In the embodiment, the loop metal portion 70 includes a coupling element 700 and the protruded metal portion 72 includes a coupling element 720. The coupling element 700 and the coupling element 720 can be used for adjusting the resonant frequency and the impedance matching. In an embodiment, the coupling element 700 and the coupling element 720 may be a lump inductor or a lump capacitor. For example, the coupling element 700 and the coupling element 720 are disposed to lower the resonant frequency when the length of the loop metal portion 70 is the same. In different embodiments, the coupling element may be selectively disposed above the loop metal portion 70 or just disposed at the protruded metal portion 72.

In different embodiments, the antenna 1 can have the combination of the above designs, for example, it includes the slot in FIG. 5 and the coupling element in FIG. 7 simultaneously, or it includes the bending portion in FIG. 4 and the size of the current null region 600 in FIG. 6 is also increased. Therefore, the resonant frequency, the bandwidth of the operating band, the impedance matching, and the size of the antenna 1 can be adjusted, and thus the antenna 1 can be designed flexibly.

It should be noted that, in the embodiment, the loop metal portion 70 is L-shaped. In other embodiments, the loop metal portion 70 also may be rectangular-shaped, circular-shaped or has other shapes, which is not limited herein. Similarly, the protruded metal portion 72 also may be L-shaped, U-shaped and T-shaped, which is not limited herein.

If the antenna only includes the loop antenna structure, the impedance matching is difficult due to the inductance, and thus the antenna is difficult to operate at broadband. Consequently, the protruded metal portion of the antenna in embodiments not only improves the impedance matching of the loop antenna at the harmonic resonant mode, but also excites the $\lambda/4$ resonant mode of the PIFA, and thus the antenna both includes the advantages of the loop antenna structure and the PIFA structure. The antenna structure operated at the low frequency is formed by the loop antenna structure which is less affected by the environment, and the loop antenna structure is not easily affected by the coupling of surrounding metal elements, and thus the clearance space required for the antenna is reduced. The operating band of the high frequency is provided by harmonic resonant modes of the loop antenna structure and the PIFA structure, so as to have broadband operations. Consequently, the antenna meets operation requirements on dual-band and broadband at WLAN.

Although the present invention has been described in considerable detail with reference to certain preferred embodiments thereof, the disclosure is not for limiting the scope. Persons having ordinary skill in the art may make various modifications and changes without departing from the scope. Therefore, the scope of the appended claims should not be limited to the description of the preferred embodiments described above.

What is claimed is:

1. An antenna, comprising:

a feeding end;

a grounding end electrically connected to a ground plane;

a loop metal portion extending from the feeding end to the grounding end to form a loop antenna structure; and a protruded metal portion electrically connected to the loop metal portion, wherein a distance between the protruded metal portion and the grounding end is shorter than the distance between the protruded metal portion and the feeding end, wherein the protruded metal portion is trapezoidal-shaped.

2. The antenna according to claim 1, wherein loop metal portion is an L-shaped loop structure, including:

a first radiating arm electrically connected to the feeding end;

a second radiating arm electrically connected to the grounding end, wherein the protruded metal portion is formed at the second radiating arm; and a connection are electrically connected to the first radiating arm and the second radiating arm.

3. The antenna according to claim 1, wherein the protruded metal portion includes at least a bending portion.

4. The antenna according to claim 1, wherein a slot is formed that extends fully through the loop metal portion and partially into the protruded metal portion, wherein the slot separates the loop metal portion into a first part and a second part, and the first part is electrically connected to the second part via the protruded metal portion.

5. The antenna according to claim 1, wherein the loop metal portion further includes a current null region, the area of the current null region determines a resonant frequency and an impedance matching of the loop antenna structure.

6. The antenna according to claim 1, wherein the loop metal portion further includes a current null region, a distance between the current null region and the ground plane determines the resonant frequency and the impedance matching of the loop antenna structure.

7. The antenna according to claim 1, wherein the coupling element is a inductor or a capacitor.

8. The antenna according, to claim 1, wherein the protruded metal portion further includes a coupling element, the coupling element is configured, to adjust a resonant frequency and impedance matching of the protruded metal portion.

9. The antenna according to claim 8, wherein the coupling, element is a inductor or a capacitor.

10. The antenna according to claim 1, wherein the loop metal portion provides a first operating band, a harmonic resonant mode of the loop metal portion and the protruded metal portion provides a second operating band, and the second operating, band is higher than the first operating band.

11. The antenna according to claim 10, wherein a length of the loop metal portion is half of wavelength of the first operating band.

12. The antenna according to claim 11, wherein a length of the protruded metal portion is between a quarter to half of wavelength of the second operating band.

13. The antenna according to claim 1, wherein the protruded metal portion and the loop metal portion forms a planar inverted F antenna (PIFA) relative to the feeding end and the around plane.

* * * * *